United States Patent [19]

Jensen et al.

[11] Patent Number: 4,930,996

[45] Date of Patent: Jun. 5, 1990

[54] IMMERSION PUMP ASSEMBLY

[75] Inventors: Niels D. Jensen; Jorgen Christensen, both of Bjerringbro, Denmark

[73] Assignee: Grundfos International a/s, Bierringbro, Denmark

[21] Appl. No.: 395,704

[22] Filed: Aug. 17, 1989

[30] Foreign Application Priority Data

Aug. 23, 1988 [DE] Fed. Rep. of Germany ..... 3828512

[51] Int. Cl.[5] ..... F04B 39/06; F01D 5/08

[52] U.S. Cl. ..... 417/373; 417/423.3; 417/423.8; 415/177

[58] Field of Search ..... 417/373, 423.3, 423.5, 417/423.7, 423.8; 415/175, 177, 180

[56] References Cited

U.S. PATENT DOCUMENTS

| | | | |
|---|---|---|---|
| 2,461,821 | 2/1949 | Howard et al. | 415/177 |
| 2,601,146 | 6/1952 | Ivanoff | 415/177 X |
| 4,191,240 | 3/1980 | Rule et al. | 417/423.8 X |
| 4,697,565 | 10/1987 | Kobayashi et al. | 417/372 X |

*Primary Examiner*—John Rivell

*Attorney, Agent, or Firm*—Balogh, Osann, Kramer, Dvorak, Genova & Traub

[57] ABSTRACT

An immersion pump assembly comprises a pump and a wet-rotor motor driving the pump. The motor and the pump have a common shaft which is closable and hollow and which is partly filled with a fluid, for dispersal of waste heat from the rotor chamber of the motor into a heat sink provided by the liquid to be conveyed by means of the pump. The shaft together with the fluid constitutes a rotating heat pipe system.

5 Claims, 2 Drawing Sheets

IMMERSION PUMP ASSEMBLY

FIELD OF THE INVENTION

The invention relates to an immersion pump assembly comprising a pump and a wet-rotor motor driving the pump and a common shaft for the motor and the pump.

An immersion pump assembly is a machine assembly for temporary or permanent installation in a liquid to be conveyed by the pump assembly. Such assemblies are also referred to as underwater motor pumps, where they are for water pumping, for example, in bored wells. It is to such underwater pumps that the invention has particular application.

BACKGROUND OF THE INVENTION

Underwater motor pumps having an output range of up to 10 kW are now mass produced for use in the water supply field, for example and the manufacturers of such pumps have accordingly sought to lower their production costs.

A first expedient to this end is to simplify the structure of a conventional pump, by ensheathing the motor stator by casting it in plastics material according to the teaching, for example, of U.S. Pat. No. 4,546,130.

A second expedient consists in providing a pump assembly with an integrated frequency changer to enable the pump to be operated at a higher rotational speed in order to increase the hydraulic power of the pump assembly. A pump assembly of this kind is disclosed in DE-A No. 36 42 727.

The second expedient is to be preferred, however, as will now be explained.

The following known relationships apply:

$$Q \sim n.D^3$$

$$H \sim n^2.D^2$$

$$P \sim n^3D^5$$

where Q is the pump delivery flow, H the delivery head, P the electrical power, n the rotational speed of the pump assembly and D the diameter of the pump impeller.

Identical output may be obtained whilst reducing the diameter of the pump assembly and/or reducing the number of stages of the pump, by increasing the rotational speed thereof. Installation costs may thereby be lowered since the cost of a well for drinking water supply, for example, is a substantial function of the well diameter.

Such cost cutting expedients give rise, however, to problems of cooling the pump assembly. The dispersal of waste heat generated in the motor of the assembly is inhibited by the thermal insulating action of the plastics material sealing means thereof by the reduction in the heat-emitting area of the assembly and by electrical heat losses in the frequency changer which is integrated with the motor of the assembly.

SUMMARY OF THE INVENTION

The invention has the fundamental object of providing adequate dispersal of heat from the heat loss sources of an immersion pump assembly.

According to the invention the shaft is constructed as a closable hollow shaft which is partly filled with a fluid so that the shaft and the fluid constitute a heat pipe system for the dispersal of waste heat from the rotor chamber of the motor into the heat sink provided by liquid which is to be conveyed by means of the pump.

In principle, a heat pipe may be regarded as a quasi-superconductor which carries heat from a hot wall of an enclosed space to colder wall surfaces, by material displacement and change of phase. In the present case, the shaft of the pump assembly is constructed as a rotary heat pipe in which other conditions obtain than in a stationary heat pipe (see DE-C3- 29 37 430). In particular, the dispersal of waste heat from the motor and/or frequency changer by means of a rotating heat pipe is in any event sufficient. The fluid in the hollow shaft is preferably water in view of its high vaporization temperature which corresponds to its condensation temperature.

The said fluid may, however, be a hydrocarbon having a vapour pressure graph higher than that of water.

In order to ensure that liquid in the hollow shaft, the evaporation of which should finally induce the cooling action, will always be present in the region of the heat source, that is to say the motor, the internal diameter of the shaft may be larger in the region of the heat source than in the area of the heat sink, that is to say the pump.

If the pump assembly is to be used in a non-vertical position and/or its speed of rotation is low, the hollow shaft may have an absorbent internal lining reliably to lead the liquid from the heat sink to the heat source.

DETAILED DESCRIPTION OF THE INVENTION

Figure 1:
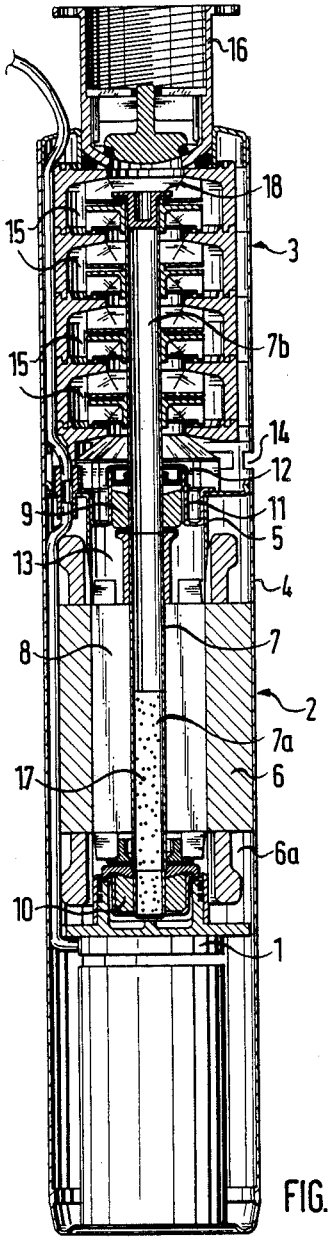
FIG. 1 is a longitudinal sectional view through an immersion pump assembly when in an inoperative condition.

As shown in FIG. 1, an immersion pump assembly pump comprises a wet-rotor motor 2, a pump body 3 of a multi-stage pump, and a frequency changer 1 combined as a structural unit by means of a common casing 4. A tubular spacing socket 5 is joined to the inner periphery of the casing 4 in fluid-tight and pressure-tight fashion so that stator 6 of the motor 2 and the frequency changer 1 are contained within a dry chamber 6*a*. For reasons of stability, the chamber 6*a* may be filled with a mineral/plastics material mixture or with an expanded plastics material.

A shaft 7 common to the motor 2 and the pump carries the rotor 8 of the motor 2 which is disposed in the socket 5 and is located both radially and axially in bearings 9 and 10. A chamber 13 defined by the socket 5 and which contains the rotor 8 and is filled with liquid, is sealed from the pump body 3 by means of a bearing plate 11 having the joint 12. The shaft 7 is hollow, being closed at its lower end open at its upper end, as shown in FIG. 1.

The pump draws the liquid to be conveyed thereby through slots 14 in the casing 4. The liquid flows successively through the stages 15 of the pump and is forced through a delivery connector 16 towards the consumer to be supplied with the liquid.

The open end of the hollow shaft 7 is closable by means of a closure cap 18 and the shaft 7 is partly filled with a fluid 17 as indicated in FIG. 1. The closure cap 18 should be removed and the fluid 17 placed in the shaft 7 before the pump assembly is put into operation. Residual air in the shaft 7 should be withdrawn therefrom to a great extent, and the interior of the shaft 7 closed in fluid-tight and air-tight fashion by means of the closure cap 18 also before the operation of the pump assembly. The shaft 7 when so prepared constitutes a heat pipe system together with the fluid 17 therein, for the dispersal of waste heat from the rotor chamber 13 of the motor 2, as explained below.

Figure 2:
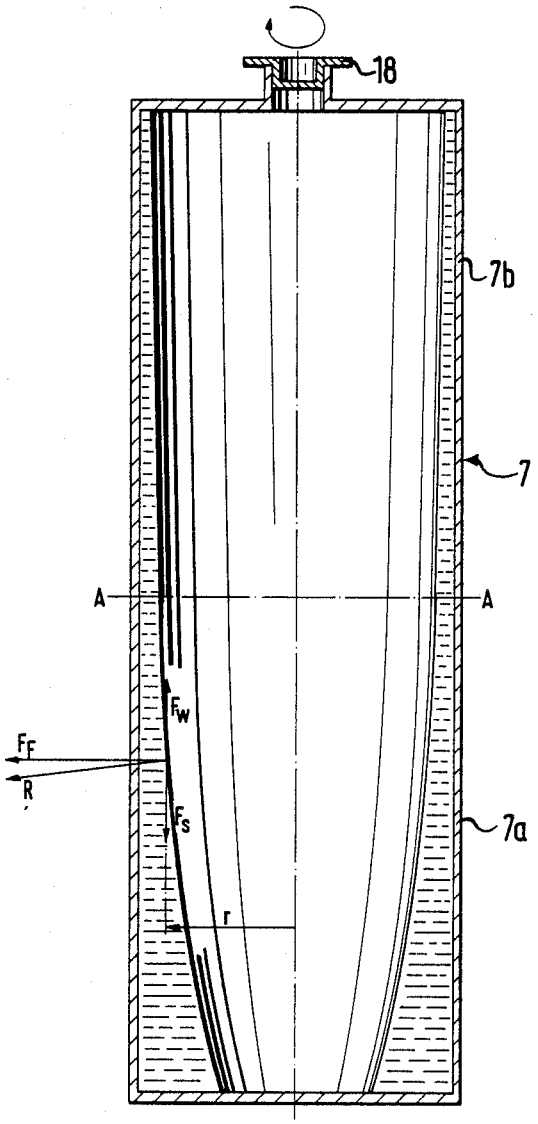
FIG. 2 is a diagrammatic longitudinal sectional view illustrating operating conditions within a rotating heat pipe of the assembly.

During operation of the pump assembly as the motor 2 rotates the shaft 7 most of the waste heat generated in the motor 2 and the frequency changer 1, flows into the rotor chamber 13 and so raises the temperature of the fluid 17 in the hollow shaft 7 in the area of a length *7a* thereof. Part of the fluid 17 is thereby vaporized and penetrates into a length *7b* of the shaft 7 within the pump body 3. Said length can therefore transfer said waste heat to the liquid being conveyed. The shaft length *7a* in the rotor chamber 13 thus constitutes the heat source, and the shaft length *7b*, the heat sink, of the heat pipe system. The conditions prevailing in said heat pipe system when the pump assembly is in operation will now be described with reference to FIG. 2. Before such operation, the hollow shaft 7 will have been filled with fluid 17, up to say a line A—A, after which the residual air in the shaft 7 will have been largely withdrawn and the interior of the shaft 7 closed fluid-tight and air-tight fashion by means of the closure cap 18, as explained above.

During the operation of the pump assembly, that is to say during the rotation of the shaft 7, the surface of the fluid 17 always extends at right angles to the field of force acting on it. The following forces act concomitantly on a fluid particle lying at the surface of the fluid 17:

the centrifugal force $F_F \sim r.w^2$, the force of gravity $F_s \sim g$, the force of resistance $F_w \sim c^2$ where r is the distance between the surface of the liquid 17 and the axis of rotation, w is the angular velocity of the shaft 7, g is the gravitational acceleration and c the vapour speed in the cross-section under consideration. The resultant of these three forces is denoted by R, to which the fluid surface extends at right angles at the corresponding point. The fluid surface will, as a whole, approximate in form to a parabola.

Heat is supplied to the shaft length *7a* in the rotor chamber 13, part of the fluid 17 being thereby vaporized and flowing into the cooler shaft length *7b* in which the vapour is finally condensed. The condensate flows back to the shaft length *7a* by virtue of the field of force.

The fluid 17 is chosen in dependence upon the absolute temperatures. Provided they allow this, water is a particularly simple and inexpensive choice. A hydrocarbon may, however, be chosen for the lower range of temperatures as compared with water, a hydrocarbon has the advantage that degassing of the fluid can be effected substantially more simply. Care should in any event be taken to ensure that the pressure within the shaft 7 corresponds approximately to the vapour pressure commensurate with the temperature of the fluid used.

The internal diameter of the hollow shaft 7 may be greater within the rotor chamber than within the pump body, in order to ensure that a stock of fluid is always available in the region of the heat source for withdrawal of waste heat, even at very high rotational speeds and/or high temperature levels.

If the pump assembly is not intended for use in a vertical position, an absorbent internal lining (not shown) should be provided in the hollow shaft 7. By virtue of a "wicking" action of said internal lining, fluid 17 is always available for vapourisation in the region of the heat source, where the pump assembly is used in an oblique or in a horizontal position.

What is claimed is:

1. An immersion pump assembly comprising a pump, a wet-rotor motor, and a shaft common to the motor and the pump connecting the motor in driving relationship with the pump, wherein the shaft is hollow and the assembly further comprises closure means for the hollow shaft and a fluid partially filling the shaft, whereby the shaft and said fluid constitute a heat pipe system for dispersing waste heat from the motor in liquid conveyed by the pump.

2. An assembly as claimed in claim 1, wherein said fluid is water, the pressure within said shaft corresponding approximately to a vapour pressure commensurate with the temperature of said water.

3. An assembly as claimed in claim 1, wherein said fluid is a hydrocarbon, the pressure within said shaft, corresponding approximately to a vapour pressure commensurate with the temperature of said hydrocarbon.

4. An assembly as claimed in claim 1, wherein the internal diameter of the hollow shaft is greater within the motor than within the pump.

5. An assembly as claimed in claim 1, wherein the hollow shaft is provided with an absorbent internal lining.

* * * * *